US005535088A

United States Patent [19]

Sato et al.

[11] Patent Number: 5,535,088

[45] Date of Patent: Jul. 9, 1996

[54] CONTACTING CHARGING DEVICE FOR ELECTROSTATIC PHOTORECEPTOR DRUM

[75] Inventors: Shougo Sato; Ding-Yu Chen; Makoto Suzuki, all of Nagoya, Japan

[73] Assignee: Brother Kogyo Kabushiki Kaisha, Nagoya, Japan

[21] Appl. No.: 252,166

[22] Filed: May 31, 1994

[30] Foreign Application Priority Data

| | | | |
|---|---|---|---|
| Jun. 17, 1993 | [JP] | Japan | 5-032637 U |
| Jul. 15, 1993 | [JP] | Japan | 5-175181 |
| Jul. 15, 1993 | [JP] | Japan | 5-175182 |

[51] Int. Cl.[6] ..... G03G 15/02

[52] U.S. Cl. ..... 361/225; 355/219

[58] Field of Search ..... 355/219; 361/225

[56] References Cited

U.S. PATENT DOCUMENTS 5,126,913 6/1992 Araya et al. .

FOREIGN PATENT DOCUMENTS

| | | | |
|---|---|---|---|
| 2-282280 | 11/1990 | Japan . | |
| 4-003182 | 1/1992 | Japan | 355/219 |
| 5-27552 | 2/1993 | Japan | 355/219 |

*Primary Examiner*—R. L. Moses

*Attorney, Agent, or Firm*—Oliff & Berridge

[57] ABSTRACT

A contacting charging device includes a sheet-shaped charging member and a support member for supporting a charging member at both of its end. A portion of the sheet-shaped charging member contacts the surface of a charge target. The sheet-shaped charging member and the charge target uniformly contact each other, to place a uniform charge on the charge target. The sheet-shaped charging member also has excellent durability.

20 Claims, 9 Drawing Sheets

CONTACTING CHARGING DEVICE FOR ELECTROSTATIC PHOTORECEPTOR DRUM

BACKGROUND OF THE INVENTION

1. Field of the Invention

This invention relates to a charging device for an electrophotographic image forming apparatus, such as a laser printer, a copying machine, a facsimile machine, etc. This invention specifically relates to a contacting type charging device.

2. Description of the Related Art

Conventionally, a corotron charger using a corona discharger and a scorotron charger are generally used to charge an electrophotographic copying machine. FIG. 13 shows a conventional corotron charger 100. The corotron charger 100 includes a wire electrode 101 having a diameter of 100 μm or less. A shield electrode 102 includes an opening for exposing an electrophotographic member (or charge target) 103 to be charged by the corotron 100. The shield electrode 102 surrounds the wire electrode 101 and is grounded. When a voltage of about 6 kV is applied to the wire electrode 101 by a power source 104, corona discharge occurs in the vicinity of the wire electrode 101, which charges the surface of the charge target 103. A scorotron charger (not shown) having a grid electrode has been used to charge a photosensitive member in the electrophotographic copying machine because uniformity of charging directly affects image quality.

However, these types of chargers used in the electrophotographic copying machine generate ozone, which is harmful to the human body and has a bad odor. Therefore, users of these devices desire a new charger, in place of the corotron charger and the scorotron, which does not have these disadvantages. In addition, the corotron charger and the scorotron charger require a high supply voltage of about 6 kV. Thus, a problem often occurs with these chargers in that a large load is applied to the power source.

In order to solve the above problems, a contactable charging device for charging the surface of the charge target has been proposed. This known contacting-type charging device has a conductive member which contacts the surface of the charge target. This charging method requires a low supply voltage and produces only an extremely small amount of ozone. Using this contactable charging device, the supply voltage can be reduced and the occurrence of ozone can be minimized.

One conventional contacting-type charging device has a conductive member for supplying a voltage and which is formed of elastic material such as rubber. This known device contacts the charge target by the elastic force of the rubber. However, if the conductive member is left for a long time in contact with the charge target, the contact force of the conductive member against the charge target becomes weak, because of fatigue of the rubber. In order to solve this problem, Japanese Laid-open Patent Publication No. 2-282280 discloses a method in which a contacting-type charging member is pushed against a charge target using the elastic flexibility of a leaf spring.

FIG. 12 shows such a leaf-spring type contacting-type charging device 90. The leaf-spring type device 90 has a leaf spring 91 which is fixed to a conductive support member 93 by a presser member 94 and a screw 95. The leaf spring 91 is arranged to be biased toward and contacting a photosensitive layer 97 provided on the surface of a photosensitive drum serving as a charge target. The photosensitive drum includes the photosensitive layer 97 coated on the surface of an aluminum tube 98. An elastic resistant layer 92 is formed on the free end of the leaf spring 91 and has a portion which contacts the photosensitive layer 97. Further, a cleaning blade 99 is provided above the periphery of the photosensitive drum to remove dust such as toner, paper powder, etc. The leaf spring 91 is formed of stainless steel having a thickness of about 100 μm. The resistant layer 92 is formed of urethane rubber or nitrile rubber (NBR) and has a thickness of about 50 to 100 μm and a resistance value of about $10^3$ Ωcm to $10^{15}$ Ωcm. The support member 93 is connected to a negative electrode of a DC power source 96 through an electric wire. In general, a voltage of about −500 V to −2000 V is applied from the DC power source 96 to the resistant layer 92.

In this contacting-type charging device, in order to enable the resistant layer 92 of the leaf spring 91 to uniformly contact the photosensitive layer 97, the leaf spring 91 must be provided with the proper flexibility. However, in the method for supporting one side of the leaf spring 91, as shown in FIG. 12, if the leaf spring 91 does not have sufficient rigidity, so that it is sufficiently biased against the photosensitive layer 92, the resistance layer 92 floats away from the photosensitive layer 97. In this case, it is very difficult to achieve uniform contact between the resistant layer 92 and the photosensitive layer 97. Therefore, the resistant layer 92 must be designed to have sufficient rigidity so that floating is prevented.

However, such a rigid elastic member has large frictional resistance. Thus, it induces a critical problem in abrasion of the resistance layer 92 and the photosensitive layer 97. Therefore, durability of the charging device is poor. On the other hand, if the frictional resistance of the surface of the resistant layer 92 is reduced to prevent abrasion, the corresponding reduction in the rigidity makes it difficult to prevent floating between the resistant layer 92 and the photosensitive layer 97. Further, in the conventional contacting-type charging device as described above, when paper powder, which cannot be removed by the cleaning blade 99, is inserted into a gap between the resistance layer 92 and the photosensitive layer 97, the charge target is not uniformly charged.

SUMMARY OF THE INVENTION

Therefore, this invention provides a contacting-type charging device having excellent durability in which the charging member and the charge target uniformly contact each other, such that the charge target can be uniformly charged.

The contacting-type charging device according to this invention has a sheet-shaped contacting charging member which is supplied with a voltage and is moved relative to a charge target. The charging member contacts the surface of the charge target to charging the surface of the charge target, and includes a support member for supporting both side ends of the contacting charging member. The sheet-shaped contactable charging member is formed by a conductive member having elastic flexibility, and is coated with a resistant member. Alternately, the sheet-shaped contacting charging member is formed of a multilayer structure containing at least one resistant layer, and has projections at a portion which contacts the surface of the charge target.

In the contacting charging device of this invention, both ends of the sheet-shaped contacting charging member in the direction of relative movement are supported by the support member. The contacting charging member contacts the surface of the charge target while a voltage is applied to the contacting charging member to charge the surface of the charge target.

It is apparent from the above description, that, in the contacting charging device of this invention, since both side ends of the sheet-shaped contactable charging member are supported by the support member, the contactable charging member may be formed of flexible material, and thus the contactable charging member will uniformly contact the charge target. As a result, the charge target can be uniformly charged. In addition, materials having high rigidity or a non-elastic material may be used for the contact portion between the contacting charging member and the charge target, to improve the durability of the contacting charging device.

BRIEF DESCRIPTION OF THE DRAWINGS

The preferred embodiments of this invention will be described in detail with reference to the following figures, wherein.

DETAILED DESCRIPTION OF THE PREFERRED EMBODIMENTS

Figure 1:
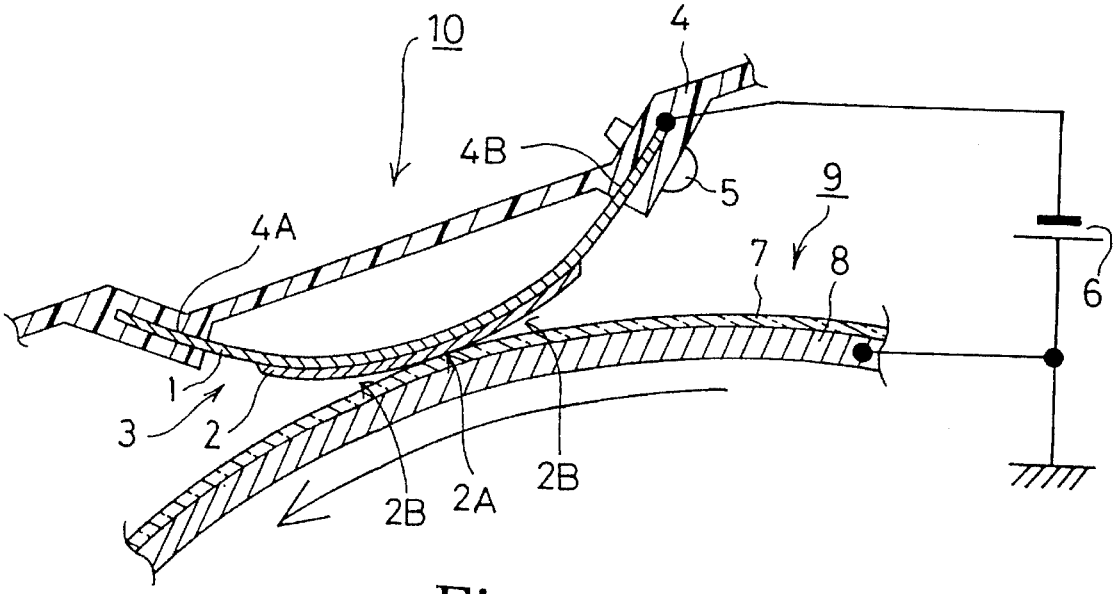
FIG. 1 is a cross-sectional view of a first embodiment of a contacting charging device.
Figure 2:
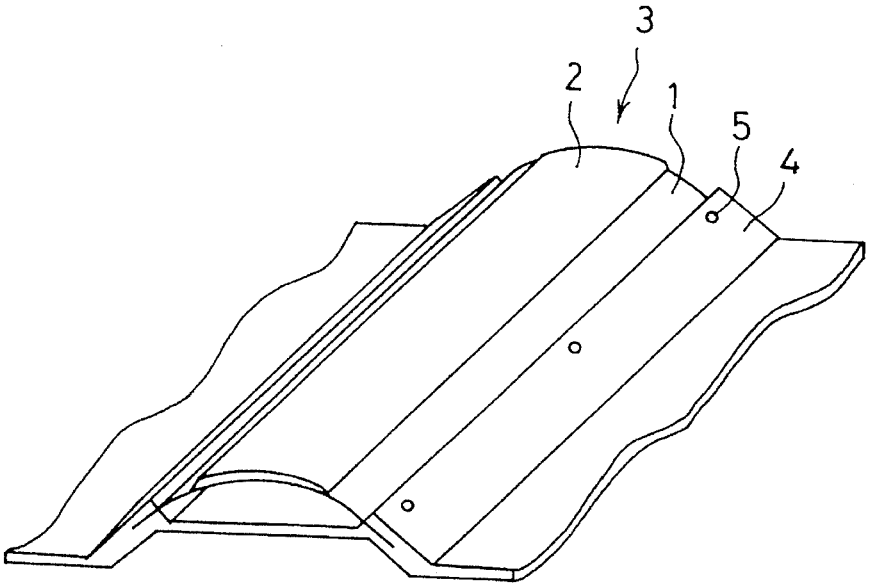
FIG. 2 is a perspective view of the first embodiment of the contacting charging device.

FIGS. 1 and 2 show a first preferred embodiment of a contacting charging device 10. In the contacting charging device 10, a sheet-shaped charging member 3 comprises a leaf spring 1 and a resistant layer 2 formed on the surface of the leaf spring 1. The leaf spring 1 is formed of stainless steel or phosphor bronze and has a thickness of 100 μm or less. The resistant layer 2 is formed of elastic material such as polyurethane rubber or nitrile rubber (NBR) or a non-elastic material such as resin. Its volume resistivity is adjusted to be about $10^5$ Ωcm to $10^{12}$ Ωcm, and is preferably $10^7$ Ωcm to $10^{10}$ Ωcm. The thickness of the resistant layer 2 is about 10 μm to 500 μm, and is preferably 20 μm to 100 μm. The resistant layer 2 is fixedly attached onto the surface of the leaf spring 1 using a heat-fusing method or a conductive adhesive agent. Alternatively, the material for the resistant layer 2 may be dissolved with solvent, and then coated directly onto the leaf spring 1 to form a charging member 3.

A photosensitive drum 9 comprises an aluminum tube 8 and a photosensitive layer 7 coated on the surface of the aluminum tube 8. The photosensitive layer 7 is formed of organic photoconductor (OPC), amorphous silicon (α-Si) or selenium. In this embodiment, OPC is preferably used. The thickness of the photosensitive layer 7 is about 20 μm. The photosensitive drum 9 is rotatably supported and rotated at a predetermined peripheral velocity, for example 47 mm/sec, in the direction indicated by an arrow of FIG. 1.

The leaf spring 1 is supported at both of its side ends in the rotational direction by a support member 4, such that the resistant layer 2 and the photosensitive layer 7 contact each other. The side ends of the leaf spring 1 are engageably inserted into grooves 4A and 4B provided in the support member 4. The upstream side of the leaf spring 1 is fixed to the support member 4 by a pin 5. It should be appreciated that the pin 5 can be replaced with any equivalent attaching member, such as a screw, a bolt and nut, a rivet, adhesive, or prongs or ribs formed in the support member 4 and extending into the grooves 4A and 4B.

The leaf spring 1 is connected to a negative electrode of a DC power source 6 through an electrical wire. In this embodiment, OPC is used for the photosensitive layer 7. Thus, the DC power source 6 applies a negative voltage to the leaf spring 1. In this case, about −500 V to −2000 V is generally applied to the leaf spring 1. Further, the aluminum tube 8 of the photosensitive drum 9 is grounded. If the support member 4 is conductive, the DC power source 6 is alternately connected to the support member 4 through the electrical wire.

The photosensitive drum 9 is rotated at the predetermined peripheral velocity in the direction indicated by the arrow in FIG. 1 by a driving means (not shown). Through this rotation, the charging member 3 is correspondingly deformed by the variations in the surface of the photosensitive layer 7. Thus, the contact between the resistant layer 2 and the photosensitive layer 7 is kept constant. Particularly, when the resistant layer 2 is formed of a non-elastic material such as resin, constant contact is kept by deforming the leaf spring 1. Further, when the resistant layer 2 is formed of an elastic material, constant contact is kept by deforming both the leaf spring 1 and the resistant layer 2.

The DC power source 6 applies the predetermined voltage to the leaf spring 1 at a predetermined timing, so that a potential difference is formed between the resistant layer 2 and the grounded aluminum tube 8. Accordingly, charges are injected at a contact 2A portion between the resistant layer 2 and the photosensitive layer 7 while discharging occurs at a non-contacting, fine-gap portion 2B between the resistance layer 2 and the photosensitive layer 7. Through the charge injection and the discharging, the surface of the photosensitive layer 7 is negatively charged. Charging the surface of the photosensitive layer 7 by the charge injection is easily affected by environmental variations. In contrast, the charging by the discharge is not easily affected by environmental variations. Accordingly, in order to conduct a stable charging, charging by the discharge phenomenon is preferably used.

However, it is very difficult to keep the predetermined fine gap interval 2B constant between the resistant layer 2 and the photosensitive layer 7 at all times when charging by the discharge. In the contacting charging device, 10, however, the resistant layer 2 and the photosensitive layer 7 contact each other at the contact portion 2A. Thus, the charge injection is conducted at this contact portion 2A while the charging by the discharge occurs at the fine gap portions 2B which are maintained constant at both sides of the contact portion 2A. More specifically, since the potential difference is larger at the upstream side of the contact portion 2A, the discharge is more efficiently conducted at the fine gap portion 2B formed at the upstream side of the contact portion 2A.

The resistance of the resistant layer 2 suppresses large current flow between the leaf spring 1 and the aluminum tube 8, so that spark discharges or arc discharges are prevented. Thus, stable corona discharge occurs. Accordingly, through the uniform contact between the resistant layer 2 and the photosensitive layer 7, the photosensitive layer 7 is stably charged at both the contact portion 2A, where the charging by the charge injection occurs, and at the fine gap portions 2B, where the charging by the discharge occurs.

Figure 3:
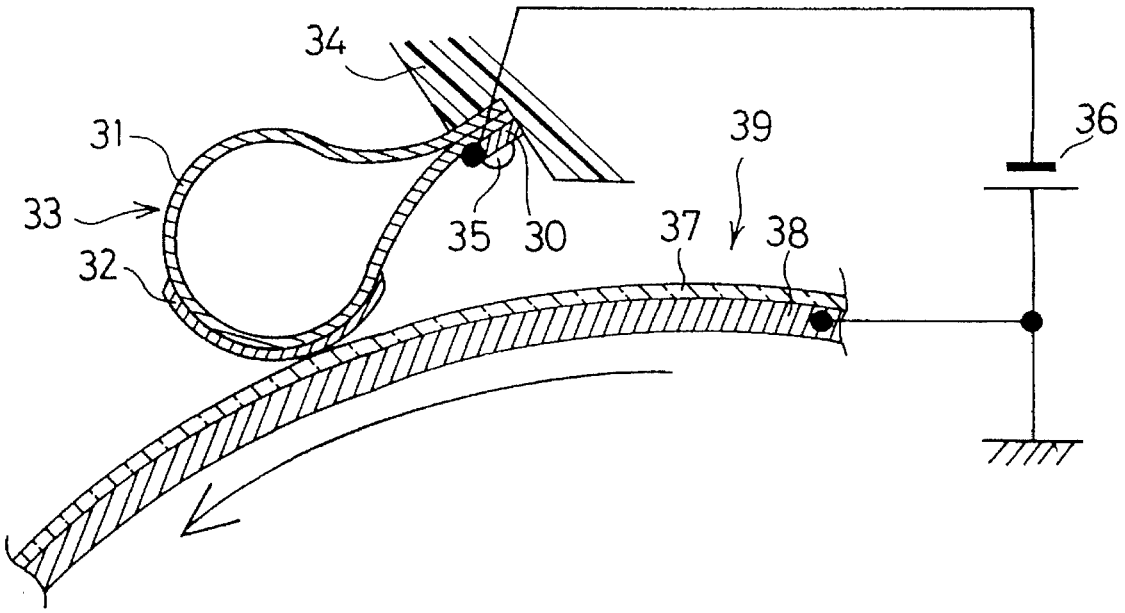
FIG. 3 is a cross-sectional view of a second embodiment of the contacting charging device.

FIG. 3 shows a second preferred embodiment, having a modification in which the sheet-shaped charging member 3 described above is bent into a loop shape and both of its ends are overlapped with each other and fixed to the same place. In this second preferred embodiment, like the first preferred embodiment shown in FIG. 1, a resistant layer 32 is provided on the surface of the leaf spring 31 to form a sheet-shaped charging member 33. A photosensitive drum 39 is constructed by coating a photosensitive layer 37 onto the surface of an aluminum tube 38. The photosensitive drum 39 is supported rotatably at a predetermined peripheral velocity in the direction indicated by an arrow of FIG. 3. The same material as the embodiment of FIG. 1 is used for the photosensitive layer 37. Both ends of the charging member 33 are supported by a support member 34 such that the resistant layer 32 and the photosensitive layer 37 contact each other. At this time, both ends of the leaf spring 31 are overlapped with each other and fixed to the support member 34 by a presser member 30 and a screw 35. The presser member 30 is formed of a conductor such as metal. One end portion of the presser member 30 is connected to the negative electrode of the DC power source 36. Accordingly, the charging member 33 is supplied with a negative voltage from the DC power source 36.

Like the first preferred embodiment shown in FIG. 1, stainless steel or phosphor bronze may be used for the leaf spring 31. However, in order to design the leaf spring 31 in a loop shape, the thickness of the leaf spring 31 is required to be below 75 μm. Further, the resist layer 32 uses the same material and thickness as the first preferred embodiment shown in FIG. 1.

Since the leaf spring 31 is designed in a loop shape, the contact force of the leaf spring 31 against the photosensitive layer 37 is sufficient even when a thin material is used for the leaf spring 31. Because the leaf spring 31 is thinner, the leaf spring 31 more easily deformed by any variations in the photosensitive layer 37. Thus, the contact between the resistant layer 32 and the photosensitive layer 37 is more uniformly maintained. This results in an advantage, since any charging variations are more easily suppressed.

Figure 4:
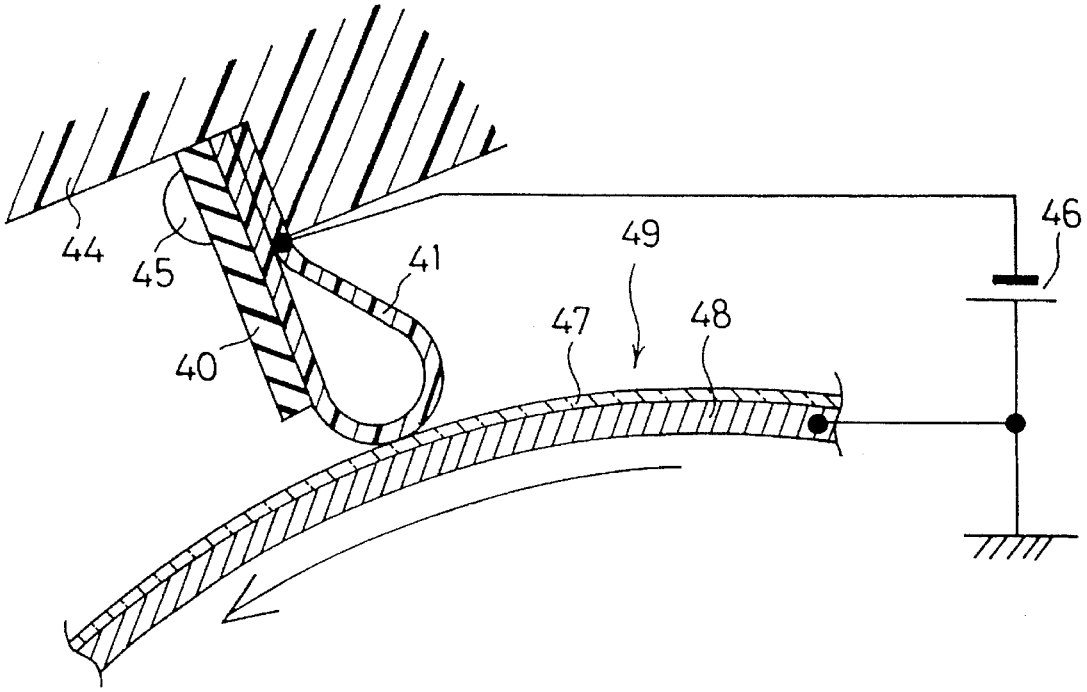
FIG. 4 is a cross-sectional view of a third embodiment of the contacting charging device.

FIG. 4 shows a third preferred embodiment, having a modification using a conductive sheet, without using a resistant layer, as the sheet-shaped charging member 41. In this third preferred embodiment, both ends of the conductive sheet 41 are supported by the support member 44, such that the conductive sheet 41 contacts the photosensitive layer 47. Both ends of the conductive sheet 41 overlap each other and are fixed to the support member 44 by a presser member 40 and a screw 45. Unlike the modification shown in FIG. 3, the presser member 40 is formed of insulating material. The presser member 40 is provided at the downstream side rotational direction of the photosensitive drum 49, so that the conductive sheet 41 is prevented from releasing its contact with the photosensitive layer 47 due to excessive deformation of the photosensitive drum 49. Therefore, the presser member 40 is positioned 2 mm to 5 mm from the photosensitive drum 49. The conductive sheet 41 is connected to the negative electrode of the DC power source 46 through an electric wire, and a negative voltage is applied from the power source 46 to the conductive sheet 41. The photosensitive drum 49 comprises an aluminum tube 48 and a photosensitive layer 47 coated on the aluminum tube 48.

The material of the conductive sheet 41 may be resin, such as polyethylene or styrene, which is kneaded with carbon to provide conductivity. The thickness of the conductive sheet 41 is about 50 μm to 200 μm. By kneading carbon into the resin, not only is the conductivity increased, but the resistivity is also increased. Further, if fluorine material is added to the material of the conductive sheet 41, or coated onto the surface of the conductive sheet 41, the friction between the conductive sheet 41 and the photosensitive layer 47 is decreased, and the abrasion-proof property of the conductive sheet 41 is improved.

Further, an elastic material such as polyurethane or nitrile rubber (NBR) may be used for the conductive sheet 41. As above, carbon is kneaded into the elastic material, such as polyurethane rubber or nitrile rubber (NBR), to provide improved conductivity and resistivity. In this case, the thickness of the conductive sheet 41 is larger (about 0.5 mm to 2 mm) than when using a non-elastic material.

According to this third preferred embodiment, the conductive sheet 41 is designed in a loop shape, and the presser member 40 is provided. Thus, sufficient contact between the conductive sheet 41 and the photosensitive layer 47 is obtained, even when material having no elasticity is used as the conductive sheet 41. Therefore, the contact between the conductive sheet 41 and the photosensitive layer 47 is uniformly maintained, and no charging variations occur.

Further, since the conductive sheet 41 is a single member, the fixing step for fixing the resistant layer to the sheet member, required in the other embodiments described above, is not required in this embodiment. Thus, the manufacturing process is more easily performed and the cost is reduced. In addition, the resistant layer does not exfoliate, nor is the thickness of the resistant layer reduced due to abrasion.

Figure 5:
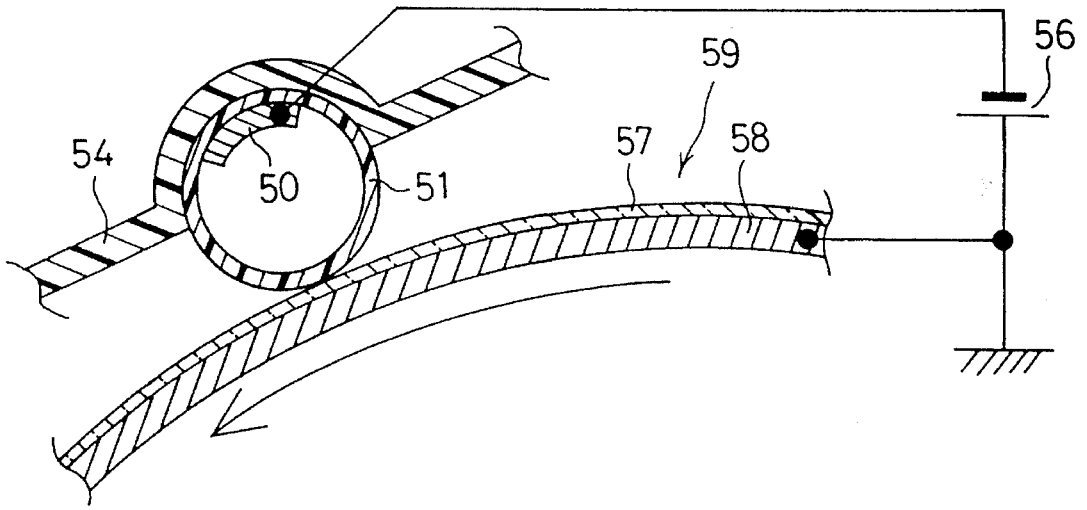
FIG. 5 is a cross-sectional view of a fourth embodiment of the contacting charging device.

FIG. 5 shows a fourth preferred embodiment, having a modification of the charging device in which the conductive sheet shown in FIG. 4 is designed in a cylindrical shape. In this fourth preferred embodiment, a cylindrical conductive sheet 51 is supported by a support member 54 such that the conductive sheet 51 contacts a photosensitive layer 57. The cylindrical conductive sheet 51 is pushed against and fixed to the support member 54 from its inner side by a presser member 50. The presser member 50 is fixed to the support member 54 by screws (not shown) provided at both of its ends. In this fourth preferred embodiment, the presser member 50 is formed of conductive material. One end portion of the presser member 50 is connected to the negative electrode of a DC power source 56 through an electric wire. Thus, a negative voltage is applied to the conductive sheet 51 by the DC power source 56. A photosensitive drum 59 comprises an aluminum tube 58 and a photosensitive layer 57 coated on the aluminum tube 48.

The same material as the conductive sheet 41 of the third preferred embodiment shown in FIG. 4 is used for the conductive sheet 51. However, in order to prevent excessive deformation of the conductive sheet 51, it is required that the conductive sheet 51 is thicker than the conductive sheet of 41. Alternatively, the conductive sheet 51 is formed of material harder than that of the conductive sheet 41.

In this embodiment, like the third preferred embodiment shown in FIG. 4, since the conductive sheet 41 is a single member, the fixing step for the resistant layer is not required. Thus, the manufacturing process is more easily performed and the cost is reduced. In addition, the resistant layer does not exfoliate nor is the thickness of the resistant layer reduced due to abrasion.

Figure 6:
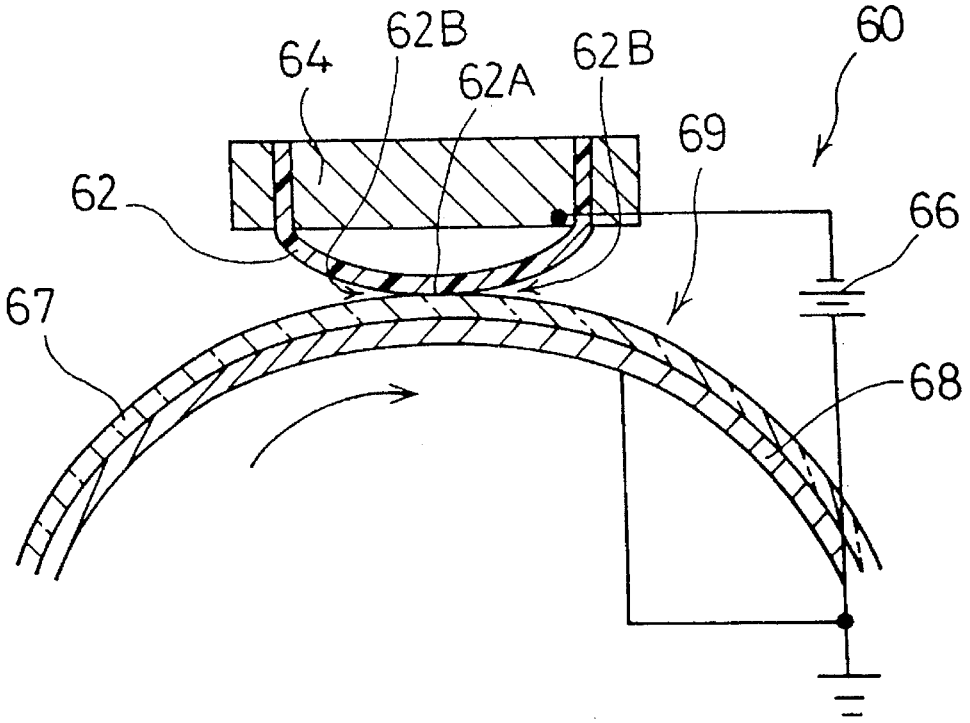
FIG. 6 is a schematic view of a fifth embodiment of the contacting charging device.

FIG. 6 shows a fifth preferred embodiment having a modification of the charging device wherein a conductive sheet having elastic flexibility and a multi-layered structure is used as the sheet-shaped charging member 62. As shown in FIG. 6, the contacting charging device 60 includes a sheet-shaped charging member 62, a metal block 64 serving as a power supply electrode and supporting the sheet-shaped charging member 62, an aluminum tube electrode 68 coated with a well-known photosensitive layer 67, and a DC power source 66 connected to the metal block 64.

Figure 7:
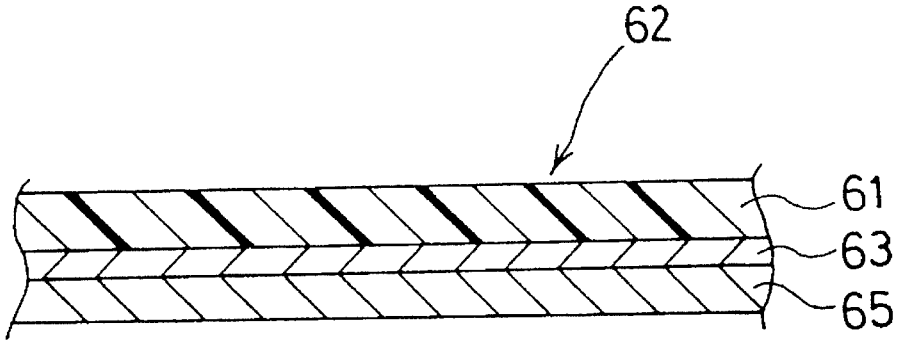
FIG. 7 is a cross-sectional view of a conductive sheet used in the fifth embodiment of the contacting charging device.

The sheet-shaped charging member 62 preferably has the structure shown in FIG. 7. That is, the sheet-shaped charging member 62 comprises a polyimide insulating layer 61 having a thickness of about 50 μm, a copper (Cu) layer 63 having a thickness of about 0.3 μm laminated onto the polyimide insulating layer 61, and a tantalum nitride (TAN) resistant layer 65 having a thickness of about 0.3 μm and laminated onto the copper layer 63. The volume resistivity of the resistant layer 65 is adjusted to be between $10^{5}$ Ωcm to $10^{12}$ Ωcm, and is preferably between $10^{7}$ Ωcm to $10^{10}$ Ωcm. In this embodiment, material having a surface resistivity of $3\times10^{8}$ Ωcm is used.

The photosensitive layer 67 may be formed from organic photoconductor (OPC), amorphous silicon (α-Si) or selenium. OPC is used in this embodiment. The photosensitive layer 67 is designed to have a thickness of about 20 μm.

As shown in FIG. 6, the sheet-shaped charging member 62 is fixed to the metal block 64 at both its ends, such that its middle portion 62A projects downwardly. The downwardly-projecting middle portion 62A of the charging member 62 is pressed against the photosensitive layer 67. The metal block 64 and the metal layer 63 of the sheet-shaped charging member 62 are electrically connected. The metal block 64 is disposed in parallel to the rotation axis of the aluminum tube electrode 68. Thus, the sheet-shaped charging member 62 extends in the width of the aluminum tube electrode 68. The sheet-shaped charging member 62 is, as a whole, elastically flexible due to the polyimide insulating layer 61. Thus, the downwardly projecting middle portion 62A is elastically deformable.

Accordingly, the sheet-shaped charging member 62, when pressed against the photosensitive layer 67, deforms correspondingly with the variations in the surface of the photosensitive layer 67. Thus, a uniform contact between the resistant layer 65 of the sheet-shaped charging member 62 and the photosensitive layer 67 is maintained.

In this fifth preferred embodiment, since a leaf spring is not used, the sheet-shaped charging member 62 is made thinner. Therefore, the sheet-shaped charging member 62 is more easily deformed by any variations in the photosensitive layer 67. The contact between the resistant layer 65 and the photosensitive layer 67 is uniformly maintained, so that any charging variations are suppressed. Further, the press force of the sheet-shaped charging member 62 against the photosensitive layer 67 is reduced. Thus, the abrasion suffered by the photosensitive layer 67 and the resistant layer 65 is suppressed and the lifetime of the photosensitive layer 67 an the resistant layer 65 is lengthened.

The photosensitive drum 69 of this fifth preferred embodiment is rotated at a predetermined peripheral velocity, for example 47 mm/sec, in the direction indicated by the arrow in FIG. 6. A DC voltage is applied across the metal block 64 and the aluminum tube electrode 68 by the DC power source 66, so that a potential difference occurs between the metal layer 63 of the sheet-shaped charging member 62 and the grounded aluminum tube electrode 68 through the resistance layer 65. Accordingly, the surface of the photosensitive layer 67 is charged at the contact portion 62A between the resistant layer 65 and the photosensitive layer 67 by the charge injection. At the same time, the photosensitive layer 62 is charged at a non-contacting, fine-gap portion 62B by the discharge. The resistance of the resistant layer 65 suppresses large current flows between the metal layer 63 and the aluminum tube electrode 68, so that no spark discharge or arc discharge occurs, and stable corona discharge can be conducted.

The photosensitive drum 69 was experimentally charged using the contacting charging device 60 of the fifth preferred embodiment. The charging potential was about −820 V for an applied voltage of about −1400 V. The charging distribution was uniform. The charging variation was 50 V or less. This demonstrates that the charging device of this fifth preferred embodiment is practically useful.

Figure 8:
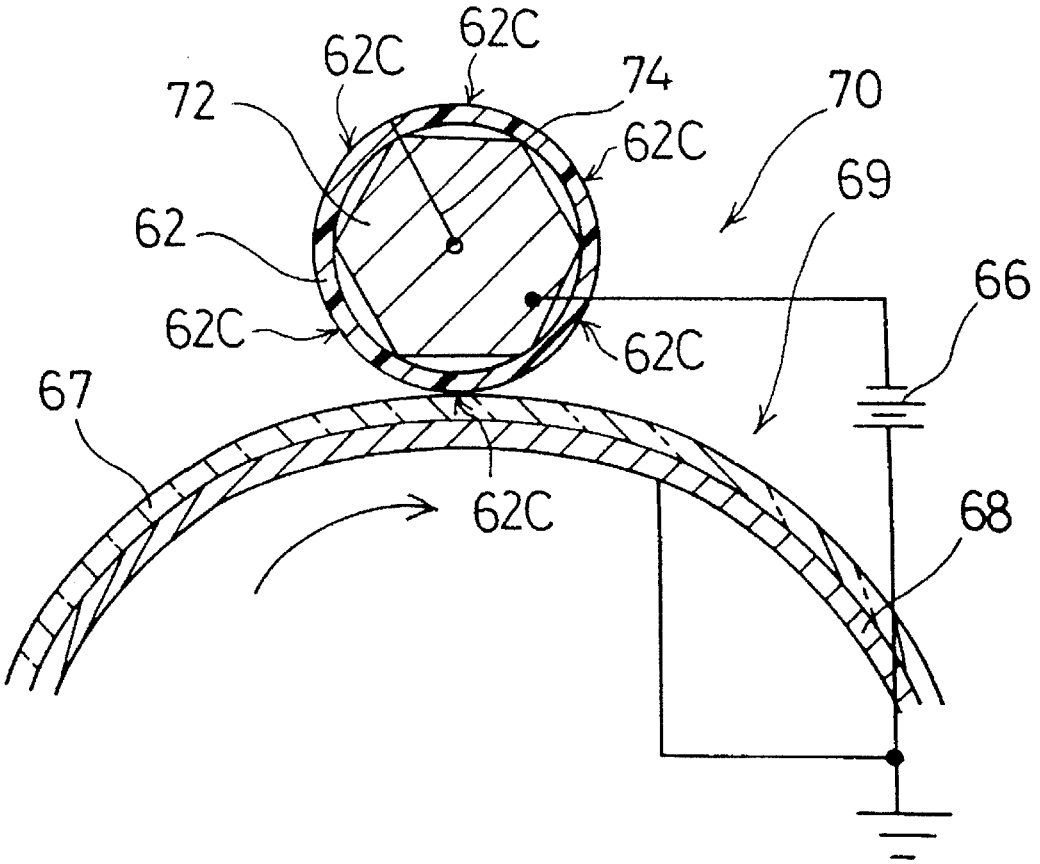
FIG. 8 is a schematic view of a sixth embodiment of the contacting charging device.

FIG. 8 shows a sixth preferred embodiment, having modification in which the conductive sheet 62 shown in FIG. 7 has a cylindrical form. In this sixth preferred embodiment, the metal block 72 supporting the sheet-shaped charging member 62 has a regular polygonal section, for example a regular hexagonal section.

The contacting charging device 70 of this embodiment is formed by winding the sheet-shaped charging member 62 around the metal block 72, which serves as a DC electrode. A slit 74 extending from one edge of the metal block 72 to its center axis is formed in the metal block 72 and extends in the axial direction of the metal block 72. Both ends of the sheet-shaped charging member 62 are fixedly inserted into the slit 74 to fix the sheet-shaped charging member 62 onto the metal block 72.

As shown in FIG. 8, the sheet-shaped charging member 62 is secured to the block 72 to contact each vertex of the metal block 72 and to be projected away from the edges of the block 72. The contacting charging device 70 is disposed such that the portions 62C of the sheet-shaped charging member 62 located between the vertices of the metal block 72 elastically contact the photosensitive layer 67. Accordingly, the sheet-shaped charging member 62 deforms correspondingly with any variations in the surface of the photosensitive layer 67. Thus, uniform contact between the resistant layer 65 of the sheet-shaped charging member 62 and the photosensitive layer 67 is maintained. Further, the metal block 72 and the metal layer 63 of the sheet-shaped charging member 62 are electrically connected, and the metal block 72 is connected to the DC power source 66.

The operation of the contacting charging device of this embodiment is identical to the operation of the fifth preferred embodiment. In this embodiment, the charging surface 62C of the sheet shaped charging member 62 is hexahedral. Thus, when one charging surface 62C is damaged or deteriorated, another charging surface 62C' may be easily exchanged for the damaged surface 62C, thus greatly improving the lifetime of the charging device 62.

In the fifth and sixth preferred embodiments, the block 72 need not be formed of metal. In this case, the DC power source 66 is directly connected to the sheet-shaped charging member 62. In the sixth preferred embodiment, the cross-section of the block 72 need not be a regular polygonal.

Figure 9:
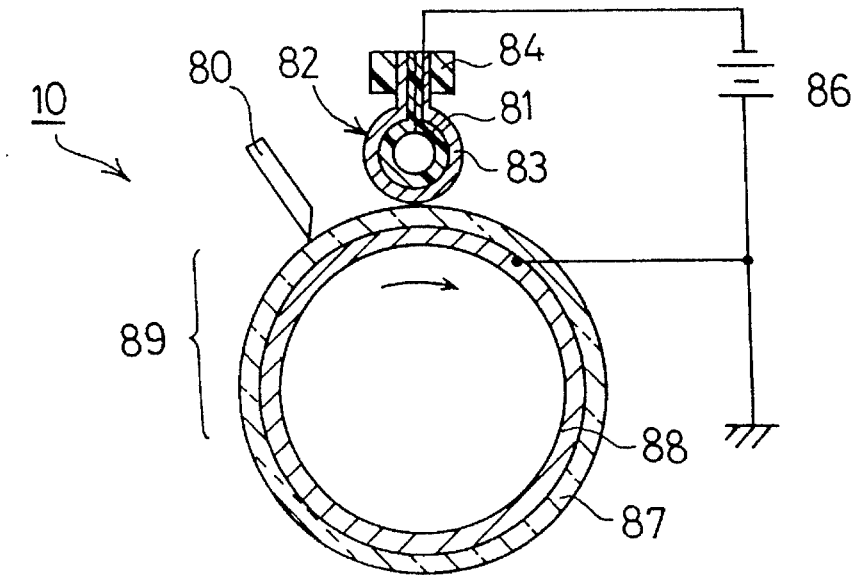
FIG. 9 is a schematic view of a seventh embodiment of the contacting charging device.
Figure 10:
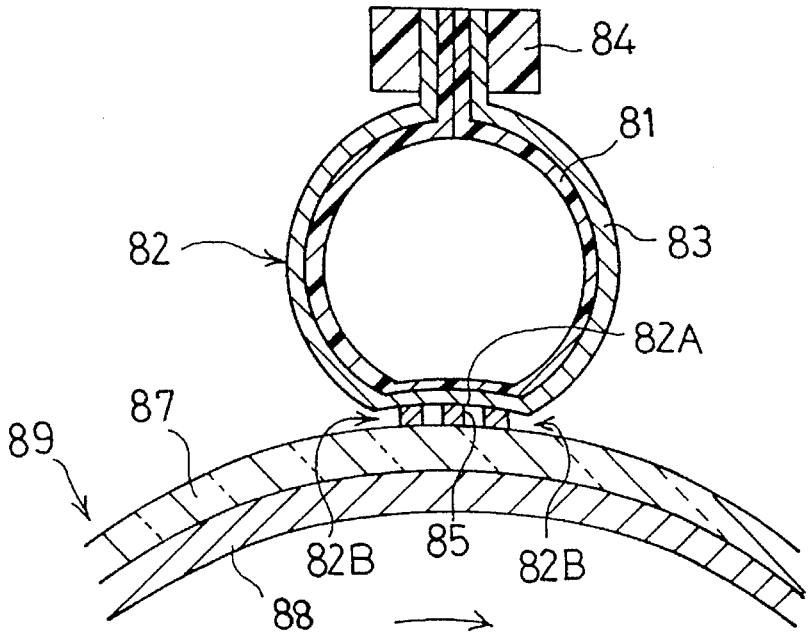
FIG. 10 is an enlarged view of a main part of the seventh embodiment of the contacting charging device.
Figure 11:
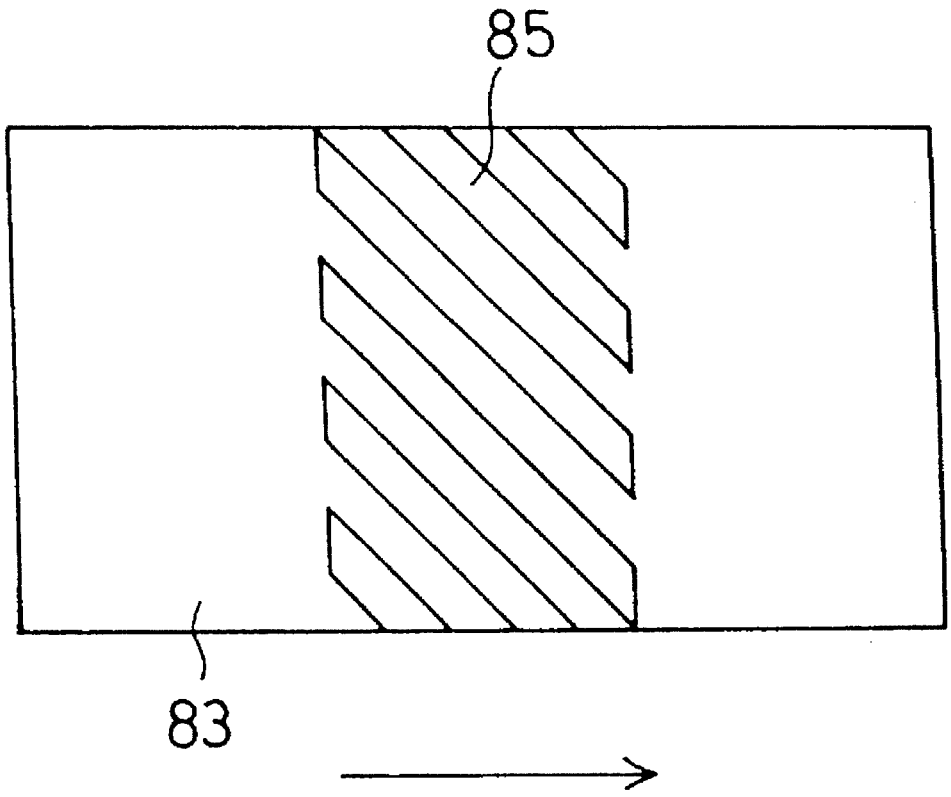
FIG. 11 is a top view of the sheet-shaped charging member of the seventh embodiment.
Figure 12:
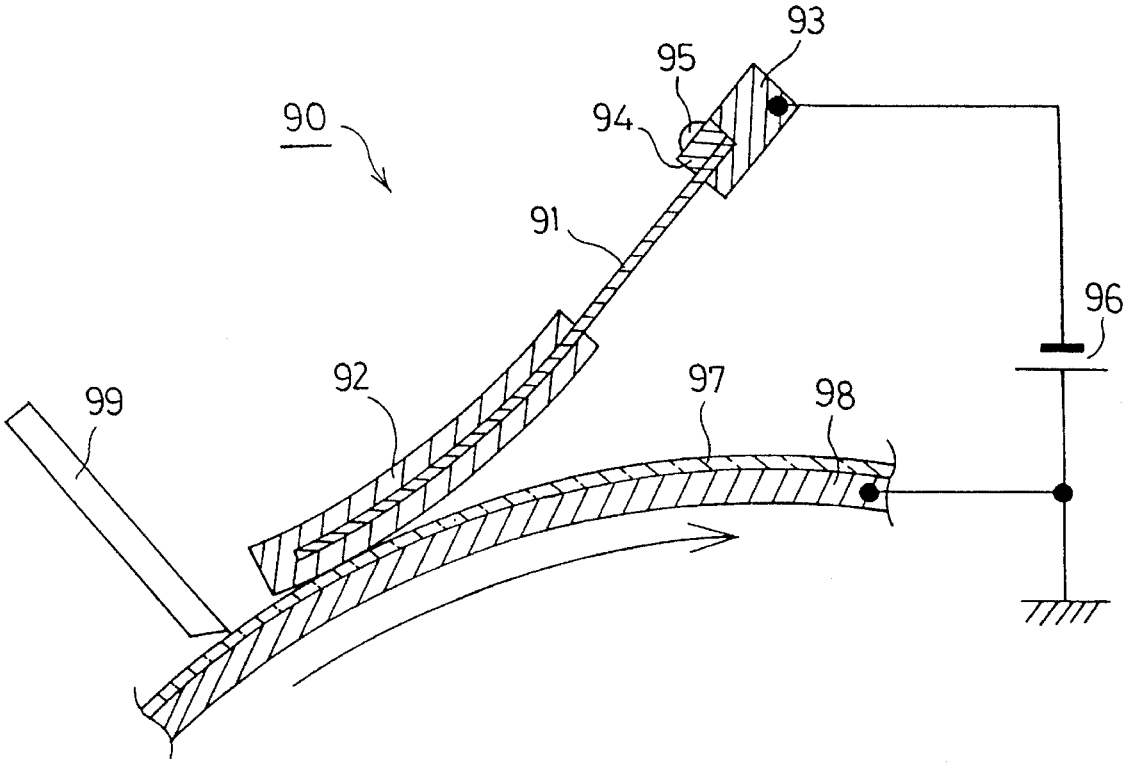
Fig.12 PRIOR ART
FIG. 12 is a cross-sectional view of a conventional contacting charging device.
Figure 13:
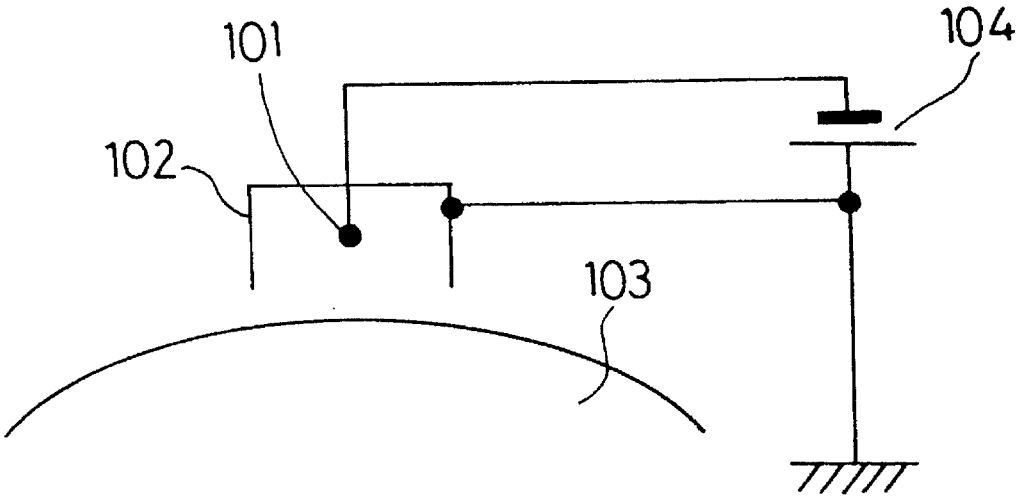
Fig.13 PRIOR ART
FIG. 13 is a schematic view of a conventional corotron charger.

FIGS. 9 to 11 show a seventh preferred embodiment, having a modification in which the sheet-shaped charging member 82 is formed by a conductive sheet having a multi-layer structure containing at least a resistant layer and having projections at a contacting portion 82A contacting the surface of the charge target 89.

As shown in FIG. 9, the contacting charging device 10 includes a sheet-shaped charging member 82 comprising an insulating layer 81 and a resistant layer 83. The sheet-shaped charging member 82 is supported by a support member 84 and takes a cylindrical shape. The sheet-shaped charging member 82 is pressed by the support member 84 against a photosensitive drum 89, which comprises a conductive layer 88 and a photosensitive layer 87. FIG. 10 is an enlarged view of the contacting portion 82A between the sheet-shaped charging member 82 and the photosensitive drum 89. As shown in FIG. 10, a conductive pattern 85 is formed on the resistant layer 83 at the contacting portion 82A of the sheet-shaped charging member 82. The conductive pattern 85 contacts the photosensitive drum 89. The resistant layer 83 of the sheet-shaped charging member 82 is connected to the DC power source 86 to be supplied with a voltage.

As shown in FIG. 11, the conductive pattern 85 is formed across the width of the resistant layer 83 of the sheet-shaped charging member 82 and perpendicular to the movement direction of the photosensitive drum 89, as indicated by an arrow at a predetermined angle. The conductive pattern 85 is formed on the resistant layer 83 by, for example, a print method.

The insulating layer 81 of the contacting charging device 10 is preferably formed of a polyimide film having a thickness of about 50 μm. The resistant layer 83 is preferably formed of a TaN thin film having a volume resistivity of about $10^5$ Ωcm to $10^{12}$ Ωcm, and preferably about $10^7$ Ωcm to $10^{10}$ Ωcm. Further, the conductive pattern 85 is preferably formed of an aluminum thin film of 3 μm to 20 μm.

The photosensitive layer 87 is preferably formed of an organic photoconductor (OPC), amorphous silicon (α-Si) or selenium and has a thickness of about 20 μm. The conductive layer 88 is preferably formed by an aluminum drum. The sheet-shaped charging member 82 is elastically deformable due to the elasticity of the polyimide film forming the insulating layer 81. Thus, it is shaped into a hollow convex form by the support member 84. The sheet-shaped charging member 82 easily deforms correspondingly to the variations in the surface of the photosensitive layer 87. Uniform contact between the resistant layer 83 of the sheet-shaped charging member 82 and the photosensitive layer 87 is thus maintained. A cleaning blade 80 is disposed above the periphery of the photosensitive drum 89 to remove dust, such as toner.

The photosensitive drum 89 is rotated in the direction indicated by the arrow at a predetermined peripheral velocity, for example 47 mm/sec. A DC voltage is applied across the resistant layer 83 and the conductive layer 88 of the photosensitive drum 89 by a DC power source 86. Therefore, a potential difference occurs between the resistant layer 83 and the grounded conductive layer 88. The surface of the photosensitive layer 87 is charged at the contacting portion 82A between the resistant layer 83 and the photosensitive layer 87 by the charge injection, and at non-contacting, fine-gap portions 82B by the discharge. At this time, the resistance of the resistant layer 83 suppresses large current flows, so that no spark discharge or no arc discharge occurs, and the photosensitive layer 87 is stably charged.

When the contacting charging device 10 of the seventh preferred embodiment is used for a long time in an electrophotographic process, dust comprising debris such as paper powder, toner powder, and/or powder of the photosensitive member collects. These dusts are a fine powder, having a diameter of 5 μm or less. Ordinarily, the dust is removed by the cleaning blade 80. However, fine dust which cannot be removed by the cleaning blade 80 collects at the contacting charging device 10. At this time, the fine dust attaches to the wall of the conductive pattern 85 formed on the surface of the sheet-shaped charging member 82, and is trapped in recess portions formed in the conductive pattern 85. Since this fine dust is completely trapped in the recess portions and the surface of the conductive pattern 85 thus maintains contact with the surface of the photosensitive layer 87 at all times, charging the photosensitive layer 87 is not affected by the fine dust.

Further, since the conductive pattern 85 is formed on the resistant layer 83 of the sheet-shaped charging member 82 perpendicular to the movement direction of the photosensitive drum 89 and the recessed portions of the conductive pattern 85 are at a predetermined angle, as shown in FIG. 11, the dust trapped in the recess portions of the conductive pattern 85 is discharged to the outside of the photosensitive drum 89. Accordingly, in the seventh preferred embodiment, the contacting charging device 10 having strong resistance against dusts, long lifetime and high reliability can be provided.

The preferred sheet-shaped charging member 82 of this embodiment comprises the insulating layer 81 and the resistant layer 83. However, it may also include a metal layer like the sheet-shaped charging member 62 of the fifth and sixth preferred embodiments. Further, the shape and materials of the conductive pattern 85 are not limited to those described above. In addition, the conductive pattern 85 of this embodiment can be included on the sheet-shaped charging members of the first to sixth embodiments.

This invention is not limited to the embodiments as described above, and various modifications may be made without departing from the subject matter of this invention. For example, in the embodiments as described above, the charging member is supplied with the DC voltage, however, it may be supplied with combination of a DC voltage and an alternating voltage.

What is claimed is:

1. A contacting charging device contacting and charging a surface of a charge target and comprising:

a sheet-shaped charging member having two opposite edges;

a support member supporting said sheet-shaped charging member by grasping only the two opposite edges of the sheet-shaped charging member; and a voltage source supplying a charging voltage to said sheet-shaped charging member.

2. The contacting charging device of claim 1, wherein said sheet-shaped charging member comprises:

a conductive member having elastic flexibility; and a resistant member having electrical resistance;

wherein said resistant member is coated on a contact portion of said conductive member to electrostatically charge the charge target.

3. The contacting charging device of claim 1, wherein said support member is formed of conductive material.

4. A contacting charging device contacting and charging a surface of a charge target and comprising:

a sheet-shaped charging member having a plurality of contacting portions, only the contacting portions contacting the surface of the charge target;

a support member supporting both ends of said sheet-shaped charging member; and a voltage source supplying a voltage to said charging member.

5. A contacting charging device contacting and charging a surface of a charge target and comprising:

an annular cylindrical charging member;

a first support member having a concave cylindrical support surface;

a second support member having a convex cylindrical support surface, wherein an outer surface of the annular cylindrical charging member is positioned in the concave cylindrical support surface and an opposing inner surface of the annular cylindrical changing member is supported by the convex cylindrical support surface, a portion of the annular cylindrical charging member being held between the concave and convex support surfaces; and a voltage source connected to one of the annular cylindrical charging member, the first support member and the second support member and supplying a charging voltage to the annular cylindrical charging member.

6. A contacting charging device contacting and charging a surface of a charge target and comprising:

a sheet-shaped charging member, comprising:

a conductive member having elastic flexibility, and a resistant member having electrical resistance, wherein said resistant member is coated on a contact portion of said conductive member to electrostatically charge the charge target;

a support member supporting two edges of said sheet-shaped charging member;

a voltage source supplying a charging voltage to said sheet-shaped charging member;

a presser member; and an attaching member, wherein two edges of the sheet-shaped charging member are held between the presser member and the support member.

7. The contacting charging device of claim 6, wherein said presser member is an electrical conductor.

8. The contacting charging device of claim 6 wherein said presser member is an electrical insulator.

9. A contact charging device contacting and charging a surface of a charge target and comprising:

a sheet-shaped charging member, comprising:

a conductive member having elastic flexibility and a thickness of at most 100 μm, and a resistant member having electrical resistance, wherein said resistant member is coated on a contact portion of said conductive member to electrostatically charge the charge target;

a support member supporting two edges of said sheet-shaped charging member; and a voltage source supplying a charging voltage to said sheet-shaped charging member.

10. A contact charging device contacting and charging a surface of a charge target and comprising:

a sheet-shaped charging member, comprising:

a conductive member having elastic flexibility, and a resistant member having a volume resistivity of about $10^5$ Ωcm to $10^{12}$ Ωcm, wherein said resistant member is coated on a contact portion of said conductive member to electrostatically charge the charge target;

a support member supporting two edges of said sheet-shaped charging member; and a voltage source supplying a charging voltage to said sheet-shaped charging member.

11. A contact charging device contacting and charging a surface of a charge target and comprising:

a sheet-shaped charging member, comprising:

a conductive member having elastic flexibility, and a resistant member having electrical resistance and a thickness of about 10 μm to 500 μm, wherein said resistant member is coated on a contact portion of said conductive member to electrostatically charge the charge target;

a support member supporting two edges of said sheet-shaped charging member; and a voltage source supplying a charging voltage to said sheet-shaped charging member.

12. A contact charging device contacting and charging a surface of a charge target and comprising:

a sheet-shaped charging member, comprising:

a conductive member having elastic flexibility, and a resistant member formed of an elastic material having electrical resistance, wherein said resistant member is coated on a contact portion of said conductive member to electrostatically charge the charge target;

a support member supporting two edges of said sheet-shaped charging member; and a voltage source supplying a charging voltage to said sheet-shaped charging member.

13. A contacting charging device contacting and charging a surface of a charge target and comprising:

a sheet-shaped charging member formed of a resin and carbon compound;

a support member supporting two edges of said sheet-shaped charging member; and a voltage source supplying a charging voltage to said sheet-shaped charging member.

14. The contacting charging device of claim 13, wherein said sheet-shaped charging member further comprises a fluorine-based material.

15. A contacting charging device contacting and charging a surface of a charge target and comprising:

a sheet-shaped charging member formed of a compound of an elastic material and carbon;

a support member supporting two edges of said sheet-shaped charging member; and a voltage source supplying a charging voltage to said sheet-shaped charging member.

16. A contacting charging device contacting and charging a surface of a charge target and comprising:

a sheet-shaped charging member having elastic flexibility, and comprising at least an insulating layer and a resistant layer;

a support member supporting two edges of said sheet-shaped charging member; and a voltage source supplying a charging voltage to said sheet-shaped charging member.

17. The contacting charging device of claim 16, wherein said sheet-shaped charging member further comprises a conductive layer.

18. A contacting charging device contacting and charging a surface of a charge target and comprising:

a sheet-shaped charging member;

a support member, having a regular polygonal cross-sectional shape, and supporting said sheet-shaped charging member, wherein said sheet-shaped charging member completely surrounds said support member; and a voltage source supplying a charging voltage to said sheet-shaped charging member.

19. A contacting charging device contacting and charging a surface of a charge target and comprising:

a sheet-shaped charging member having a plurality of projections at a contacting portion of said sheet-shaped charging member which contact the surface of the charge target;

a support member supporting two edges of said sheet-shaped charging member; and a voltage source supplying a charging voltage to said sheet-shaped charging member.

20. The contacting charging device of claim 19, wherein said plurality of projections are formed on said sheet-shaped charging member in a conductive pattern.

* * * * *